US008831495B2

(12) United States Patent
Kim et al.

(10) Patent No.: US 8,831,495 B2
(45) Date of Patent: Sep. 9, 2014

(54) FUSING DEVICE AND IMAGE FORMING APPARATUS HAVING THE SAME

(75) Inventors: Hwan Hee Kim, Hwaseong-si (KR); Jae Myoung Choi, Suwon-si (KR); Dong Jin Seol, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 279 days.

(21) Appl. No.: 13/334,898

(22) Filed: Dec. 22, 2011

(65) Prior Publication Data

US 2012/0163882 A1 Jun. 28, 2012

(30) Foreign Application Priority Data

Dec. 22, 2010 (KR) ..... 10-2010-0132597

(51) Int. Cl.
*G03G 15/20* (2006.01)

(52) U.S. Cl.
CPC .... *G03G 15/2025* (2013.01); *G03G 2215/2035* (2013.01)
USPC ..... 399/329; 399/328

(58) Field of Classification Search
USPC ..... 399/328, 329
See application file for complete search history.

(56) References Cited

U.S. PATENT DOCUMENTS

| | | | | |
|---|---|---|---|---|
| 5,852,763 | A * | 12/1998 | Okuda et al. | 399/329 |
| 5,874,710 | A * | 2/1999 | Yoshimoto et al. | 219/216 |
| 6,456,819 | B1 * | 9/2002 | Abe et al. | 399/329 |
| 7,917,073 | B2 * | 3/2011 | Miyata et al. | 399/329 |
| 2001/0019676 | A1 * | 9/2001 | Okubo et al. | 399/328 |
| 2003/0170054 | A1 * | 9/2003 | Suzuki et al. | 399/328 |
| 2004/0151522 | A1 * | 8/2004 | Kato et al. | 399/328 |
| 2007/0280756 | A1 * | 12/2007 | Matsumoto | 399/329 |
| 2009/0041515 | A1 * | 2/2009 | Kim | 399/324 |
| 2009/0092423 | A1 * | 4/2009 | Shin et al. | 399/329 |
| 2009/0208264 | A1 * | 8/2009 | Fujiwara et al. | 399/329 |
| 2010/0202809 | A1 * | 8/2010 | Shinshi et al. | 399/329 |
| 2011/0076071 | A1 * | 3/2011 | Yamaguchi et al. | 399/329 |
| 2011/0100972 | A1 * | 5/2011 | Ikegami et al. | 219/216 |
| 2011/0135353 | A1 * | 6/2011 | Creteau et al. | 399/329 |
| 2011/0170917 | A1 * | 7/2011 | Yoshikawa et al. | 399/329 |
| 2012/0121305 | A1 * | 5/2012 | Yoshikawa et al. | 399/329 |

FOREIGN PATENT DOCUMENTS

| | | |
|---|---|---|
| JP | 2006-072218 | 3/2006 |

* cited by examiner

*Primary Examiner* — David Bolduc
(74) *Attorney, Agent, or Firm* — Staas & Halsey LLP

(57) ABSTRACT

A fusing device to reduce lubricant leakage, includes a fusing belt having a heat source placed therein, a pressure roller placed to apply pressure to an outer surface of the fusing belt, and a nip plate to support an inner surface of the fusing belt so as to define a fusing nip between the fusing belt and the pressure roller. The nip plate includes a stepped portion spaced apart from the inner surface of the fusing belt so as to define a space for accommodation of a lubricant applied to the inner surface of the fusing belt. The fusing device may further include a side frame to rotatably support a longitudinal end of the fusing belt. The side frame may be provided with a lubricant guide to guide the lubricant on the longitudinal end of the fusing belt toward the center of the fusing belt.

19 Claims, 10 Drawing Sheets

1

FUSING DEVICE AND IMAGE FORMING APPARATUS HAVING THE SAME

CROSS-REFERENCE TO RELATED APPLICATION

This application claims the priority benefit of Korean Patent Application No. 10-2010-0132597, filed on Dec. 22, 2010 in the Korean Intellectual Property Office, the disclosure of which is incorporated herein by reference.

BACKGROUND

1. Field

Embodiments relate to a fusing device to fix an image to a recording medium and an image forming apparatus having the same.

2. Description of the Related Art

An image forming apparatus is designed to print an image on a recording medium. Examples of image forming apparatuses include printers, copiers, fax machines, and devices combining functions thereof.

In an electro-photographic image forming apparatus, a photoconductor, which has been charged with a predetermined electric potential, is exposed to light such that an electrostatic latent image is formed on a surface of the photoconductor. Thereafter, developer is fed to the electrostatic latent image to forma visible image. The visible image formed on the photoconductor is transferred to a recording medium and then, is fixed to the recording medium while passing through a fusing device.

A generally widely used fusing device includes a heating unit containing a heat source therein, and a pressure unit arranged to come into close contact with the heating unit to define a fusing nip with the heating unit. If the recording medium, on which the image has been transferred, is introduced into the fusing nip between the heating unit and the pressure unit, the image is fixed to the recording medium by heat and pressure.

The heating unit and the pressure unit of the fusing device include rotators including rollers, a belt, etc. To reduce frictional resistance of the rotators so as to ensure smooth rotation of the rotators, a lubricant is applied to the rotators.

SUMMARY

It is an aspect of one or more embodiments to provide a fusing device to maintain fusing performance via smooth operation of constituent elements, and an image forming apparatus having the same.

It is another aspect of one or more embodiments to provide a fusing device to reduce leakage of a lubricant and an image forming apparatus having the same.

Additional aspects of the invention will be set forth in part in the description which follows and, in part, will be apparent from the description, or may be learned by practice of the invention.

In accordance with an aspect of one or more embodiments, a fusing device includes a fusing belt disposed in a rotatable manner, a heat source placed in the fusing belt to heat the fusing belt, a pressure roller placed to apply pressure to an outer surface of the fusing belt, and a nip plate to support an inner surface of the fusing belt so as to define a fusing nip between the fusing belt and the pressure roller, wherein the nip plate includes a pressure portion arranged to face the pressure roller and to apply pressure to the inner surface of the fusing belt, and a stepped portion located at an outer side of the pressure portion with respect to a longitudinal direction of the nip plate, the stepped portion being spaced apart from the inner surface of the fusing belt so as to define a space for accommodation of a lubricant applied to the inner surface of the fusing belt.

The fusing device may further include aside frame placed to rotatably support a longitudinal end of the fusing belt, and the side frame may include a side belt guide inserted in the fusing belt so as to support the inner surface of the fusing belt, and at least one lubricant guide protruding from the side belt guide to guide the lubricant on the end of the fusing belt toward the center of the fusing belt.

The nip plate may include an extension bent from the pressure portion to extend in a direction away from the inner surface of the fusing belt.

The pressure roller may include a shaft, and an elastic layer surrounding the circumference of the shaft to define the fusing nip when the pressure roller is pushed toward the nip plate, and a bending junction of the nip plate where the pressure portion and the extension meet each other may be located at an outer side of the elastic layer with respect to an axial direction of the pressure roller.

A distance between the elastic layer and the bending junction of the nip plate with respect to the axial direction of the pressure roller may be in a range of about 2 mm to about 5 mm.

The fusing device may further include a belt guide member placed near the fusing nip to guide the inner surface of the fusing belt, the belt guide member may include sidewalls extending in a direction away from the fusing belt to define a space with the inner surface of the fusing belt, and the space for accommodation of the lubricant may be defined by the stepped portion of the nip plate and the sidewalls of the belt guide member.

The lubricant guide may include a ramp inclined from the end of the fusing belt toward the center of the fusing belt in a rotating direction of the fusing belt.

The lubricant guide may have a symmetrical shape about an axis parallel to the longitudinal direction of the fusing belt.

The side belt guide may extend in an arcuate shape along an inner surface of the fusing belt, and the at least one lubricant guide may include a plurality of lubricant guides arranged on an outer circumference of the side belt guide in the rotating direction of the fusing belt.

The side frame may further include a restraint wall to limit longitudinal movement of the fusing belt, and the side belt guide may include a lubricant accommodation channel provided between the lubricant guide and the restraint wall with respect to a longitudinal direction of the fusing belt, the lubricant accommodation channel extending in a rotating direction of the fusing belt.

The side belt guide may include a first portion extending toward the center of the fusing belt, and a second portion extending from the first portion toward the center of the fusing belt, the second portion being inclined relative to the first portion in a direction away from the inner surface of the fusing belt.

In accordance with another aspect of one or more embodiments, a fusing device includes a heat source to generate heat, a fusing belt to rotate around the heat source, the fusing belt being heated by the heat source, a pressure roller to come into contact with an outer surface of the fusing belt, at a pressure, a side frame including a side belt guide to rotatably support an inner surface of the fusing belt at a longitudinal end of the fusing belt, and at least one lubricant guide protruding from the side belt guide to guide the lubricant on the end of the fusing belt toward the center of the fusing belt during rotation of the fusing belt, a nip plate including a pressure portion arranged to face the pressure roller and adapted to apply pressure to the inner surface of the fusing belt so as to define a fusing nip between the fusing belt and the pressure roller, and a belt guide member to support the nip plate and guide the inner surface of the fusing belt near the fusing nip, the belt guide member including a lubricant receptacle defining a space with the inner surface of the fusing belt for accommodation of the lubricant on the inner surface of the fusing belt when the lubricant is pushed to the longitudinal end of the fusing belt by the pressure applied to the fusing nip.

The nip plate may include an extension bent from the pressure portion to extend in a direction away from the inner surface of the fusing belt, and a stepped portion located in the lubricant receptacle of the belt guide member and spaced apart from the inner surface of the fusing belt.

The pressure roller may include a shaft, and an elastic layer surrounding the circumference of the shaft to define the fusing nip when the pressure roller is pushed toward the nip plate, and the lubricant receptacle of the belt guide member may be located at an outer side of the elastic layer with respect to an axial direction of the pressure roller.

The belt guide member may include an arcuate first guide to guide the inner surface of the fusing belt at an upstream position of the nip plate with respect to a rotating direction of the fusing belt, and an arcuate second guide to guide the inner surface of the fusing belt at a downstream position of the nip plate with respect to the rotating direction of the fusing belt, and the first guide and the second guide of the belt guide member may be provided at longitudinal ends thereof with grooves extending in the rotating direction of the fusing belt.

The lubricant guide of the side frame may include a ramp inclined from the end of the fusing belt toward the center of the fusing belt in the rotating direction of the fusing belt.

The side belt guide may have an arcuate shape, both ends of the arcuate side belt guide may be connected respectively to the first guide and the second guide of the belt guide member, and the at least one lubricant guide may include a plurality of lubricant guides arranged on an outer circumference of the side belt guide in the rotating direction of the fusing belt.

Two of the lubricant guides may be arranged adjacent to the respective ends of the side belt guide connected to the first guide and the second guide of the belt guide member, and another lubricant guide may be located at the center of the side belt guide with respect to the rotating direction of the fusing belt.

In accordance with a further aspect of one or more embodiments, an image forming apparatus includes a fusing device to apply heat and pressure to a recording medium passing through a fusing nip so as to fix a non-fused image to the recording medium, wherein the fusing device includes a heat source to generate heat, a fusing belt placed to be heated by the heat source, the fusing belt coming into contact with a surface of the recording medium on which the non-fused image has been formed so as to transfer heat thereto, a pressure roller to come into contact with an outer surface of the fusing belt at a pressure, a nip plate to support an inner surface of the fusing belt so as to define a fusing nip between the fusing belt and the pressure roller, the nip plate including a pressure portion arranged to face the pressure roller and adapted to apply pressure to the inner surface of the fusing belt and a stepped portion located at an outer side of the pressure portion with respect to a longitudinal direction of the nip plate, the stepped portion being spaced apart from the inner surface of the fusing belt so as to define a space for accommodation of a lubricant applied to the inner surface of the fusing belt, and a belt guide member placed to accommodate the nip plate and guide the inner surface of the fusing belt near the fusing nip, the belt guide member having an opening to allow heat radiated from the heat source to be directly transferred to the nip plate, a support member placed to support the belt guide member and having an opening to directly pass the heat radiated from the heat source, and a heat transfer member placed between the heat source and the fusing belt, the heat transfer member including a body configured to surround the heat source and heated by the heat source, an opening to allow heat radiated from the heat source to be directly transferred to the fusing belt, and a heat transfer portion to come into contact with the nip plate.

BRIEF DESCRIPTION OF THE DRAWINGS

These and/or other aspects of one or more embodiments will become apparent and more readily appreciated from the following description of embodiments, taken in conjunction with the accompanying drawings of which.

DETAILED DESCRIPTION

Figure 1:
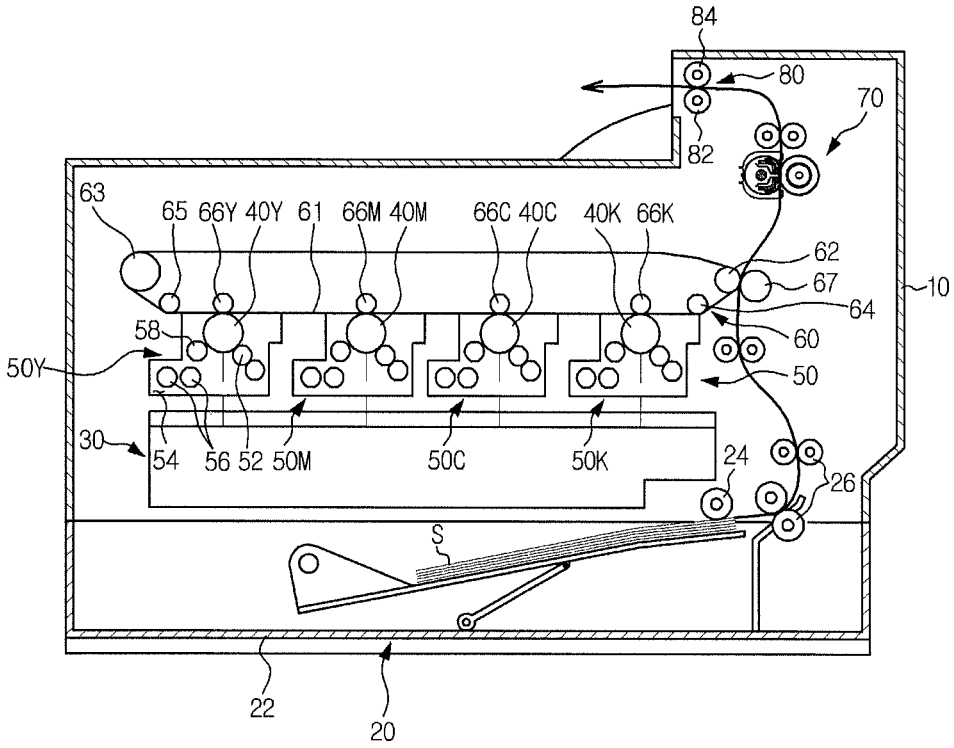
FIG. 1 is a view illustrating a configuration of an image forming apparatus according to an embodiment.

Reference will now be made in detail to embodiments of, examples of which are illustrated in the accompanying drawings, wherein like reference numerals refer to like elements throughout. FIG. 1 is a view illustrating a configuration of an image forming apparatus according to an embodiment.

As illustrated in FIG. 1, the image forming apparatus 1 includes a main body 10, a recording medium feeding device 20, a light scanning device 30, a plurality of photoconductors 40Y, 40M, 40C and 40K, a developing device 50, a transfer device 60, a fusing device 70, and a recording medium discharge device 80.

The main body 10 defines an external appearance of the image forming apparatus and supports a variety of elements installed therein. The main body 10 may be provided with an opening/closing part to allow the user to access the interior of the main body 10 through an opening of the main body 10 when it is desired to replace or repair the variety of elements or to remove a recording medium jammed in the main body 10.

The recording medium feeding device 20 feeds recording media S toward the transfer device 60. The recording medium feeding device 20 includes a cassette 22 in which the recording media S are accommodated, a pickup roller 24 to pick up the recording media S accommodated in the cassette 22 one by one, and delivery rollers 26 to deliver the picked-up recording medium toward the transfer device 60.

The light scanning device 30 irradiates light corresponding to image information to the photoconductors 40Y, 40M, 40C and 40K to form electrostatic latent images on surfaces of the photoconductors 40Y, 40M, 40C and 40K. Although not illustrated in the drawings, the light scanning device 30 may include a light source to emit light beams, a deflector including a polygonal mirror to deflect the light beams when rotated by a motor, and an f-theta lens to focus the deflected light beams to the photoconductors 40Y, 40M, 40C and 40K.

The developing device 50 forms visible images by supplying developers to the electrostatic latent images formed on the photoconductors 40Y, 40M, 40C and 40K. The developing device 50 consists of four developing units 50Y, 50M, 50C and 50K in which different colors of developers, for example, black K, cyan C, magenta M, and yellow Y developers are accommodated respectively.

The developing units 50Y, 50M, 50C and 50K may respectively include chargers 52, developer reservoirs 54, developer delivery members 56, and developing members 58. The chargers 52 charge the surfaces of the photoconductors 40Y, 40M, 40C and 40K before the electrostatic latent images are formed on the photoconductors 40Y, 40M, 40C and 40K. The developer delivery members 56 deliver the developers stored in the developer reservoirs 54 to the developing members 58. The developing members 58 supply the developers to the electrostatic latent images formed on the photoconductors 40Y, 40M, 40C and 40K to form visible images.

Although FIG. 1 illustrates an embodiment in which the four photoconductors 40Y, 40M, 40C and 40K are provided respectively in the developing units 50Y, 50M, 50C and 50K, alternatively, four developing units may function to form visible images on a single photoconductor.

The transfer device 60 transfers the visible images from the photoconductors 40Y, 40M, 40C and 40K to the recording medium. The transfer device 60 includes a transfer belt 61, a drive roller 62, a support roller 63, tension rollers 64 and 65, and transfer rollers 66Y, 66M, 66C and 66K.

The transfer belt 61 is rotatably supported by the drive roller 62 and the support roller 63. The drive roller 62 is rotated upon receiving power from a drive source (not shown) mounted in the main body 10. The support roller 63 is located at an opposite side of the drive roller 62 to support an inner surface of the transfer belt 61.

The respective photoconductors 40Y, 40M, 40C and 40K are arranged to face an outer surface of the transfer belt 61. The transfer rollers 66Y, 66M, 66C and 66K are arranged to support the inner surface of the transfer belt 61 at positions corresponding to the respective photoconductors 40Y, 40M, 40C and 40K.

When the image forming apparatus 1 performs a color printing operation, the transfer rollers 66Y, 66M, 66C and 66K are pushed toward the respective photoconductors 40Y, 40M, 40C and 40K. Thus, the transfer rollers 66Y, 66M, 66C and 66K transfer the visible images formed on the respective photoconductors 40Y, 40M, 40C and 40K to the transfer belt 61 such that the images overlap one another on the transfer belt 61. The resulting image on the transfer belt 61 is transferred to the recording medium fed from the recording medium feeding device 20 while the recording medium passes between the transfer roller 67 and the transfer belt 61.

On the other hand, when the image forming apparatus 1 performs a black-and-white printing operation, only the transfer roller 66K is pushed toward the photoconductor 40K, and the other transfer rollers 66Y, 66M and 66C are spaced apart from the corresponding photoconductors 40Y, 40M and 40C.

The recording medium having passed through the transfer device 60 enters the fusing device 70. As the fusing device 70 applies heat and pressure to the recording medium, the non-fused image on the recording medium is fixed to the recording medium.

The recording medium having passed through the fusing device 70 is guided to the recording medium discharge device 80 to thereby be discharged out of the main body 10 by the recording medium discharge device 80. The recording medium discharge device 80 includes a discharge roller 82 and a discharge backup roller 84 facing the discharge roller 82.

Figure 2:
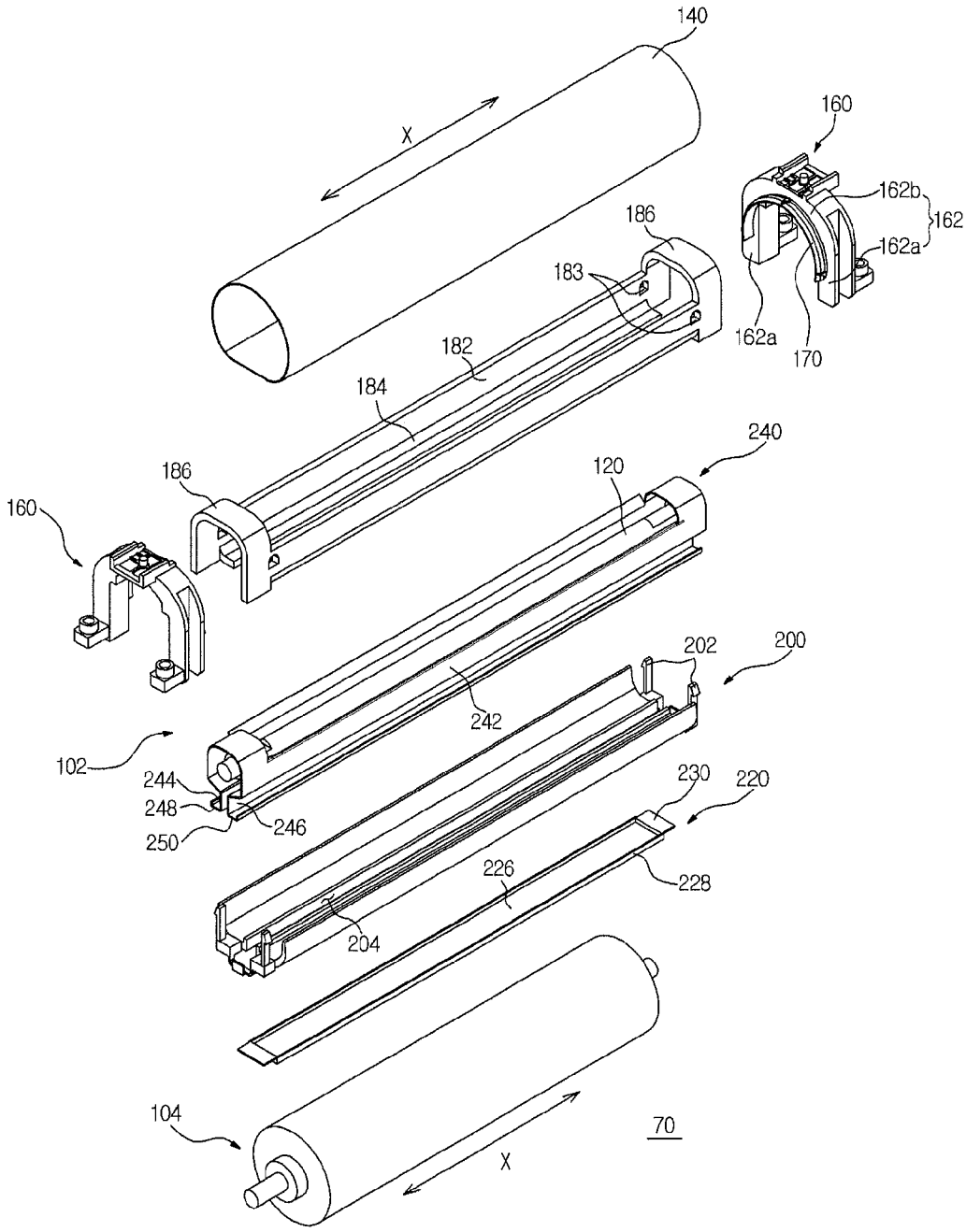
FIGS. 2 and 3 are respectively an exploded perspective view and a sectional view illustrating a configuration of a fusing device according to an embodiment.
Figure 3:
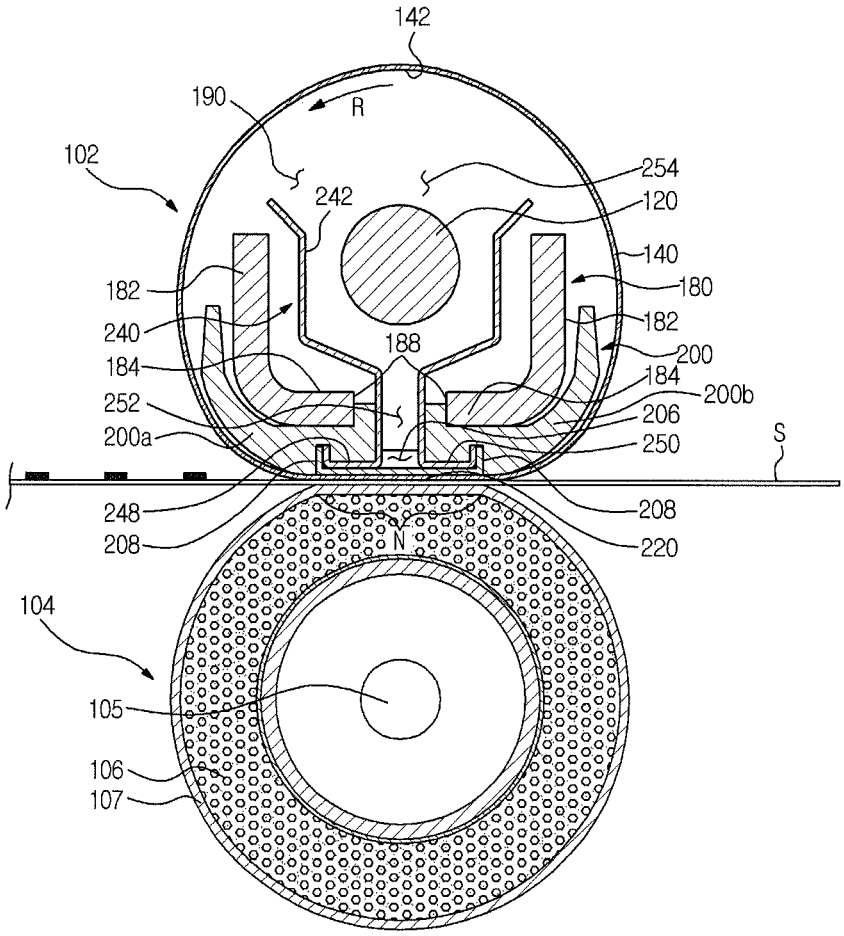
Figure 4:
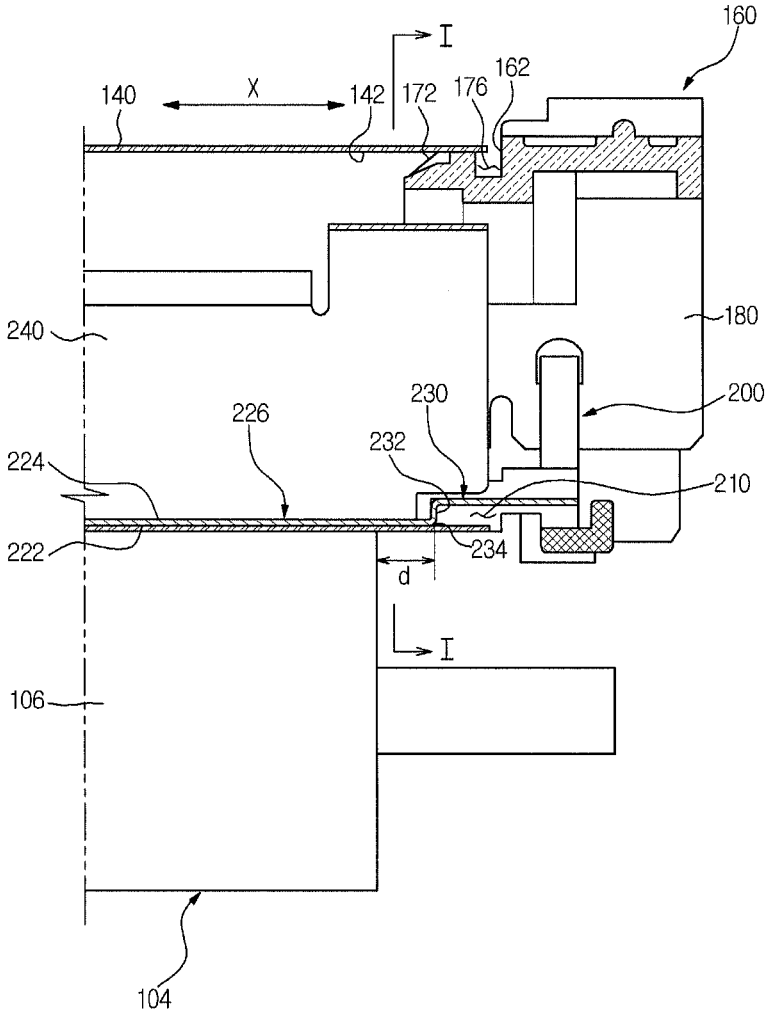
FIG. 4 is a sectional view illustrating a configuration of a longitudinal end of the fusing device according to an embodiment.

FIGS. 2 and 3 are respectively an exploded perspective view and a sectional view illustrating the fusing device according to an embodiment. FIG. 4 is a sectional view illustrating a configuration of a longitudinal end of the fusing device according to the embodiment.

As illustrated in FIGS. 2 to 4, the fusing device 70 includes a heating unit 102 and a pressure roller 104. In the following description, a longitudinal direction X of the fusing device 70 is defined as a direction corresponding to an axial direction of the pressure roller 104. The longitudinal direction X of the fusing device 70 may be represented as a longitudinal direction of a constituent element of the heating unit 102 including, e.g., a fusing belt 140, a belt guide member 200, or a nip plate 220.

The heating unit 102 and the pressure roller 104 are arranged to face each other to define a fusing nip N through which the recording medium S passes. The heating unit 102 may be arranged to come into contact with a surface of the recording medium S on which a non-fused image has been formed, so as to apply heat to the recording medium S. The pressure roller 104 is arranged to come into contact with the heating unit 102 at a pressure.

The heating unit 102 includes a heat source 120 to generate heat and the fusing belt 140 rotatably placed around the heat source 120. The fusing belt 140 is rotatably engaged with the pressure roller 104.

The pressure roller 104 is arranged to face the fusing belt 140. The pressure roller 104 comes into close contact with the fusing belt 140 to define the fusing nip N when a predetermined pressure is applied thereto. The pressure roller 104 is rotated upon receiving power from the drive source (not shown) mounted in the main body 10. While the recording medium S, on which the developer image has been transferred, passes through the fusing nip N between the pressure roller 104 and the fusing belt 140, the developer image is fixed to the recording medium S by heat and pressure.

The pressure roller 104 includes a shaft 105 and an elastic layer 106. The shaft 105 is located in the center of the pressure roller 104 and functions as a rotating shaft. The shaft 105 also functions to support elements placed thereon. The shaft 105 may be made of a metallic material, such as aluminum or steel. The elastic layer 106 is configured to surround the shaft 105 and is elastically deformed when the pressure roller 104 comes into contact with the fusing belt 140 at a pressure, thereby allowing the fusing nip N to be defined between the pressure roller 104 and the fusing belt 140. The elastic layer 106 may conventionally be made of silicon rubber.

A release layer 107 may be provided on a surface of the elastic layer 106 to prevent the recording medium from being adhered to the pressure roller 104. The release layer 107 may be a tubular layer made of fluorine resin, such as perfluoroalkoxy (PFA).

Both ends of the fusing belt 140 with respect to a longitudinal direction X of the fusing belt 140 are rotatably supported by side frames 160. The fusing belt 140 is heated by the heat source 120 and transfers heat to the recording medium S passing through the fusing nip N.

The heat source 120 is placed inside the fusing belt 140. As both ends of the heat source 120 are respectively coupled to side covers and the side covers are secured to the side frames 160, the heat source 120 is supported by the side frames 160. The heat source 120 may include at least one halogen lamp.

The side frames 160 are respectively arranged at opposite sides of the fusing belt 140 in the longitudinal direction X of the fusing belt 140. Each of the side frames 160 includes a restraint wall 162 to prevent longitudinal movement of the fusing belt 140 and a side belt guide 170 to support an inner surface of the end of the fusing belt 140. The restraint wall 162 includes two legs 162*a* arranged side by side with a distance therebetween and a connector 162*b* to connect the two legs 162*a* to each other.

The side belt guide 170 protrudes from the restraint wall 162 and is inserted into the fusing belt 140. The side belt guide 170 has an arcuate shape and extends throughout the two legs 162*a* and the connector 162*b*. An outer circumference of the side belt guide 170 supports the inner surface of the end of the fusing belt 140 to guide rotation of the fusing belt 140.

A support member 180 is placed between the two side frames 160. The support member 180 functions as a basic framework to support constituent elements of the heating unit 102 and thus, may be made of a material having high rigidity so as not to be easily deformed by external force.

The support member 180 may include support plates 182, bending plates 184 and connecting plates 186.

The support plates 182 extend in the longitudinal direction X of the fusing device 70 between the two side frames 160 and are arranged in parallel to each other with a distance therebetween. The connecting plates 186 connect longitudinal ends of the support plates 182 to each other. The connecting plates 186 are inserted into the side frames 160 so as to be coupled thereto. An assembly of the support member 180 and the side frames 160 defines a framework of the heating unit 102.

The bending plates 184 are bent inward from the support plates 182. The bending plates 184 are seated on an inner surface of the belt guide member 200 to support the belt guide member 200.

The bending plates 184 define a first opening 188 therebetween. Heat radiated from the heat source 120 is partially transferred to the fusing nip N through the first opening 188.

The support member 180 has a second opening 190 at an opposite side of the first opening 188. The second opening 190 allows the heat radiated from the heat source 120 to directly pass through the support member 180 to thereby directly reach the fusing belt 140.

The belt guide member 200 supports an inner surface 142 of the fusing belt 140 near the fusing nip N and guides rotation of the fusing belt 140. The belt guide member 200 extends in the longitudinal direction X of the fusing belt 140.

The belt guide member 200 is provided at both longitudinal ends thereof with hooks 202 protruding toward the support member 180. The support plates 182 of the support member 180 have fastening holes 183 corresponding to the hooks 202. As the hooks 202 are inserted between the support plates 182 and then, noses of the hooks 202 are caught by the fastening holes 183, the belt guide member 200 is coupled to the support member 180.

The belt guide member 200 has a third opening 204 corresponding to the first opening 188 of the support member 180. The heat radiated from the heat source 120 may be directly transferred to the fusing nip N through the first opening 188 of the support member 180 and the third opening 204 of the belt guide member 200.

The belt guide member 200 includes a first guide 200*a* and a second guide 200*b* respectively arranged upstream and downstream of the third opening 204 with respect to a rotating direction R of the fusing belt 140. The first guide 200*a* and the second guide 200*b* have arcuate outer surfaces to guide smooth rotation of the fusing belt 140. Ends of the first guide 200*a* and the second guide 200*b* of the belt guide member 200 are connected to both ends of the arcuate side belt guide 170 (see FIG. 7).

An outer surface of the belt guide member 200 facing the inner surface 142 of the fusing belt 140 is provided with an accommodation groove 206 in the longitudinal direction X of the fusing belt 140. The accommodation groove 206 communicates with the third opening 204 of the belt guide member 200. Specifically, the accommodation groove 206 extends in opposite directions from the third opening 204 such that a part of the groove 206 is formed in the first guide 200*a* and another part of the groove 206 is formed in the second guide 200*b*.

The nip plate 220 is placed in the accommodation groove 206 of the belt guide member 200. The nip plate 220 supports the inner surface 142 of the fusing belt 140 to ensure that the fusing nip N is defined between an outer surface of the fusing belt 140 and the pressure roller 104. The nip plate 220 has a first surface 222 facing the inner surface 142 of the fusing belt 140 and a second surface 224 opposite the first surface 222.

The nip plate 220 includes a pressure portion 226 extending in the longitudinal direction X of the fusing belt 140. The pressure portion 226 comes into contact with the inner surface 142 of the fusing belt 140 and is arranged to face the pressure roller 104 so as to apply pressure to the fusing belt 140. Rim walls 228 protrude from opposite transversal ends of the second surface 224 of the pressure portion 226.

The belt guide member 200 includes sidewalls 208 extending in a direction away from the fusing belt 140 so as to define the accommodation groove 206. When the nip plate 220 is placed in the accommodation groove 206, the rim walls 228 of the nip plate 220 are supported by the sidewalls 208 of the belt guide member 200.

The nip plate 220 may be made of a material having low specific heat and high thermal conductivity to efficiently transfer heat to the recording medium. For example, the nip plate 220 may be made of aluminum. Also, the nip plate 220 may be provided with an oxide film (not shown) via anodizing, and a ceramic-Teflon coating layer may be formed on the oxide film.

The nip plate 220 applies pressure to the inner surface 142 of the fusing belt 140 which applies pressure to the outer surface of the fusing belt 140. If excessive friction occurs between the fusing belt 140 and the nip plate 220, the fusing belt 140 may be damaged or efficient rotation of the fusing belt 140 may be impossible. Thus, to reduce friction between the fusing belt 140 and the nip plate 220, a lubricant, such as grease, may be applied to the inner surface 142 of the fusing belt 140.

A heat transfer member 240 may be placed between the heat source 120 and the fusing belt 140. The heat transfer member 240 includes a body 242 and first and second legs 244 and 246.

The body 242 is configured to surround the heat source 120 and is heated by the heat source 120. The first leg 244 extends from one end of the body 242 toward the fusing belt 140 and the second leg 246 extends from the other end of the body 242 toward the fusing belt 140. The first leg 244 and the second leg 246 are fitted through the first opening 188 of the support member 180 and the third opening 204 of the belt guide member 200. An inner surface of the belt guide member 200 defining the third opening 204 supports outer surfaces of the first leg 244 and the second leg 246 of the heat transfer member 240.

The end of the first leg 244 is bent toward the first guide 200*a* of the belt guide member 200 to form a first heat transfer portion 248. The end of the second leg 246 is bent toward the second guide 200*b* of the belt guide member 200 to form a second heat transfer portion 250.

Each of the first heat transfer portion 248 and the second heat transfer portion 250 has one surface coming into contact with the nip plate 220 to transfer heat to the nip plate 220, the other surface of the first heat transfer portion 248 or the second heat transfer portion 250 being supported by the outer surface of the belt guide member 200.

A fourth opening 252 is defined between the first leg 244 and the second leg 246. The heat source 120 directly heats the nip plate 220 through the fourth opening 252 of the heat transfer member 240, and the heated nip plate 220 transfers heat to the fusing belt 140.

The body 242 of the heat transfer member 240 further includes a fifth opening 254 at an opposite side of the fourth opening 252. Thus, the heat source 120 may directly heat the fusing belt 140 through the fifth opening 254 of the heat transfer member 240 and the second opening 190 of the support member 180. This may allow a more rapid increase in the temperature of the fusing belt 140 and may prevent the temperature of the fusing belt 140 from dropping during rotation of the fusing belt 140.

Figure 5:
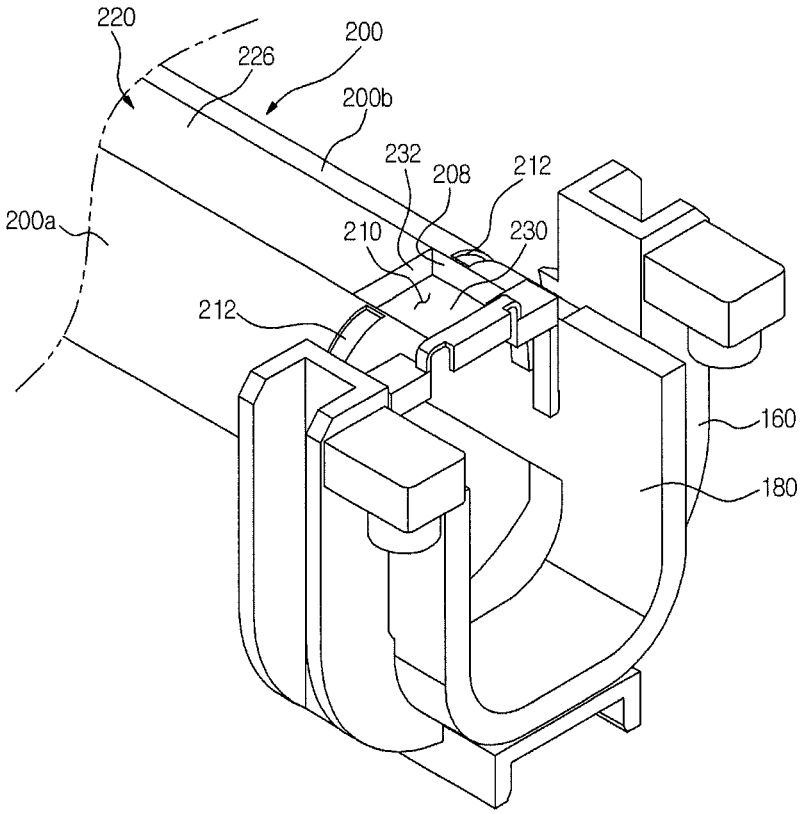
FIG. 5 is a perspective view illustrating the end of the fusing device according to an embodiment.

FIG. 5 is a perspective view illustrating the end of the fusing device according to an embodiment. In FIG. 5, the fusing belt is omitted.

A lubricant receptacle 210 is provided in a longitudinal end of the belt guide member 200. Although FIGS. 4 and 5 illustrate the lubricant receptacle 210 as being provided in one end of the belt guide member 200, another lubricant receptacle may further be provided in the other end of the belt guide member 200.

A space is defined between the lubricant receptacle 210 and the inner surface 142 of the fusing belt 140. The space serves to accommodate the lubricant on the inner surface 142 of the fusing belt 140 when the lubricant is pushed to a longitudinal end of the fusing belt 140 by pressure applied to the fusing nip N.

As the lubricant pushed from the fusing nip N to the longitudinal end of the fusing belt 140 is accommodated in the lubricant receptacle 210, the lubricant receptacle 210 serves to prevent the lubricant from leaking to the outer surface of the fusing belt 140. This may prevent contamination of recording media and peripheral elements due to lubricant leakage. In addition, damage of the fusing belt 140 caused when friction between the fusing belt 140 and the nip plate 220 increases by lubricant leakage may be prevented. Preventing lubricant leakage may also prevent slippage of the fusing belt 140 relative to the pressure roller 104.

The lubricant receptacle 210 may be defined by the sidewalls 208 of the belt guide member 200 extending in the direction away from the fusing belt 140 and a stepped portion 230 of the nip plate 220 placed between the sidewalls 208.

The stepped portion 230 of the nip plate 220 is located at an outer side of the pressure portion 226 with respect to a longitudinal direction X of the nip plate 220. The stepped portion 230 of the nip plate 220 defines a lubricant accommodation space with the inner surface 142 of the fusing belt 140. The first surface 222 of the nip plate 220 corresponding to the stepped portion 230 is spaced apart from the inner surface 142 of the fusing belt 140.

The pressure portion 226 and the stepped portion 230 of the nip plate 220 are connected to each other via an extension 232. The extension 232 is bent from the pressure portion 226 to extend in a direction away from the inner surface 142 of the fusing belt 140. The stepped portion 230 is bent from the extension 232 to extend in the longitudinal direction of the fusing belt 140.

If a bending junction 234 of the nip plate 220 where the pressure portion 226 and the extension 232 meet each other is located to receive pressure applied by the pressure roller 104, the bending junction 234 may have a high possibility of damaging the inner surface 142 of the fusing belt 140. Thus, as illustrated in FIG. 4, the bending junction 234 of the nip plate 220 may be located at the outer side of the elastic layer 106 of the pressure roller 104 with respect to the axial direction X of the pressure roller 104.

A distance d between the elastic layer 106 and the bending junction 234 of the nip plate 220 with respect to the axial direction X of the pressure roller 104 may be in a range of 2 mm to 5 mm. The pressure roller 104 may axially move within a predetermined range due to an assembly tolerance thereof during operation of the fusing device 70, and the elastic layer 106 of the pressure roller 104 may axially expand when heated. If the distance d between the elastic layer 106 of the pressure roller 104 and the bending junction 234 of the nip plate 220 is less than 2 mm, the elastic layer 106 may apply pressure to the bending junction 234 upon axial movement and expansion of the pressure roller 104, causing damage to the fusing belt 140. On the contrary, if the distance d is greater than 5 mm, the lubricant accommodation space is reduced, increasing leakage possibility of the lubricant accommodated in the lubricant receptacle 210 to the outside of the fusing belt 140.

As illustrated in FIG. 5, grooves 212 may be formed in ends of the first guide 200*a* and the second guide 200*b* with respect to the longitudinal direction X of the belt guide member 200. The grooves 212 extend in a rotating direction of the fusing belt 140. The grooves 212 provide a lubricant accommodation space between the longitudinal ends of the first guide 200*a* and the second guide 200*b* and the inner surface 142 of the fusing belt 140, thereby preventing lubricant leakage.

Although FIGS. 4 and 5 illustrate an embodiment in which the stepped portion 230 of the nip plate 220 defines one wall of the lubricant receptacle 210, another embodiment in which the lubricant receptacle is defined without the stepped portion 230 of the nip plate 220 may be possible.

Figure 6:
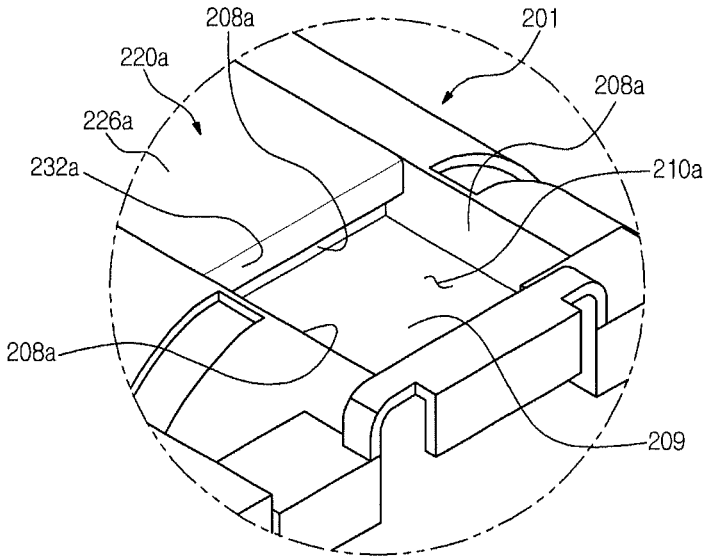
FIG. 6 is a view illustrating an alternative embodiment in which a lubricant receptacle is defined without a stepped portion of a nip plate.

For example, as illustrated in FIG. 6, a lubricant receptacle 210*a* may be defined by sidewalls 208*a* and a bottom wall 209 of the belt guide member 201.

The sidewalls 208*a* of the belt guide member 201 extend in a direction away from the inner surface 142 of the fusing belt 140. The bottom wall 209 of the belt guide member 201 is spaced apart from the inner surface 142 of the fusing belt 140.

A nip plate 220*a* may include a pressure portion 226*a* located to apply pressure to the inner surface 142 of the fusing belt 140, and an extension 232*a* bent from the pressure portion 226*a* into the lubricant receptacle 210*a*.

The fusing device 70 has a configuration to return the lubricant pushed to the longitudinal end of the fusing belt 140 toward the longitudinal center of the fusing belt 140 during rotation of the fusing belt 140.

Figure 7:
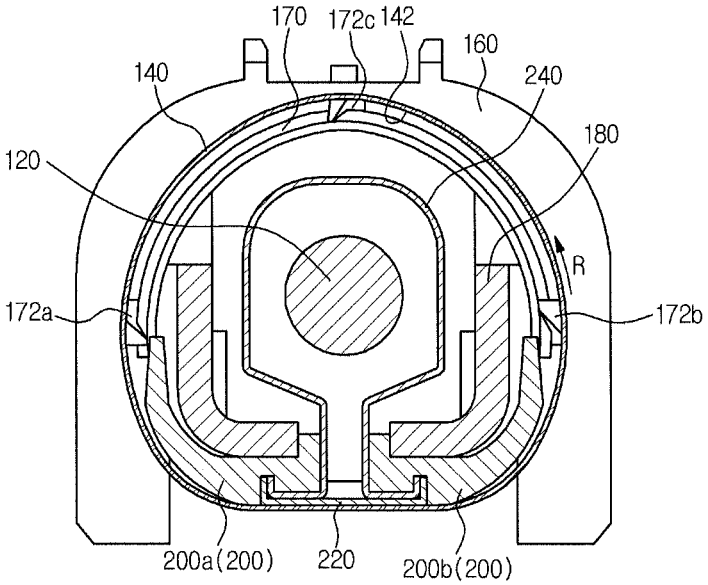
FIG. 7 is a sectional view taken along the line I-I of FIG. 4.
Figure 8:
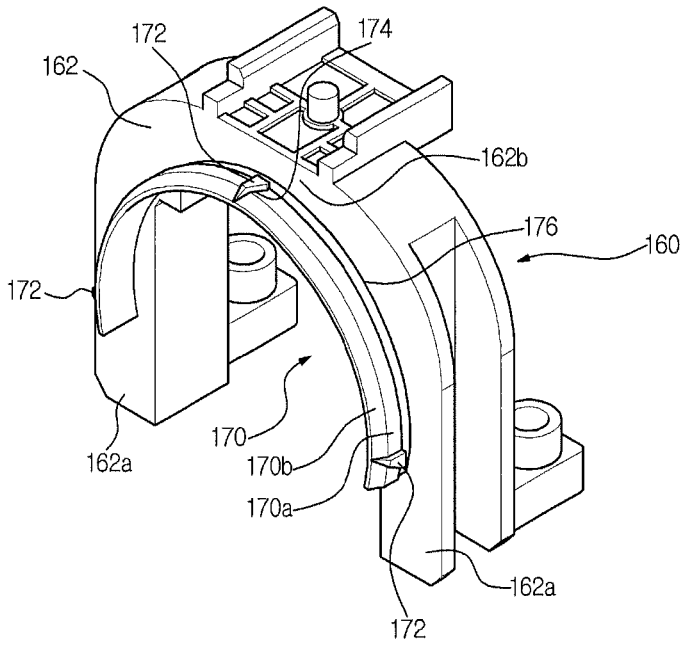
FIG. 8 is a perspective view illustrating a side frame of the fusing device according to an embodiment.
Figure 9:
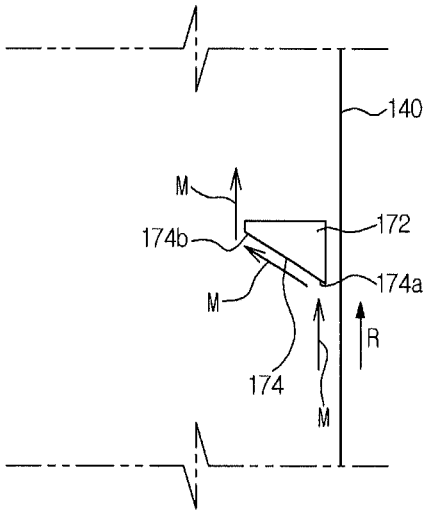
FIG. 9 is a view explaining lubricant guiding operation of a lubricant guide of the fusing device according to an embodiment.

FIG. 7 is a sectional view taken along the line I-I of FIG. 4, FIG. 8 is a perspective view illustrating the side frame of the fusing device according to an embodiment, and FIG. 9 is a view explaining lubricant guiding operation of a lubricant guide of the fusing device according to an embodiment.

As illustrated in FIGS. 7 to 9, the side frame 160 includes a lubricant guide 172 protruding from the side belt guide 170 so as to come into contact with the inner surface 142 of the fusing belt 140 at the longitudinal end of the fusing belt 140.

The lubricant guide 172 has a ramp 174 inclined from the end toward the center of the fusing belt 140 in the rotating direction R of the fusing belt 140. An outer end 174*a* of the ramp 174 is located upstream of an inner end 174*b* of the slope 174 with respect to the rotating direction R of the fusing belt 140.

The lubricant on the end of the fusing belt 140 moves toward the center of the fusing belt 140 under guidance of the ramp 174 of the lubricant guide 172 during rotation of the fusing belt 140. This may prevent leakage of the lubricant to the outside of the fusing belt 140. In FIG. 9, the arrows M diagrammatically show the lubricant guided by the lubricant guide 172 during rotation of the fusing belt 140.

A plurality of lubricant guides 172 may be arranged on the outer circumference of the belt guide 170 in the rotating direction R of the fusing belt 140. Although FIG. 7 illustrates an embodiment in which three lubricant guides 172 are arranged, the number of the lubricant guides 172 may be changed.

Of the plurality of lubricant guides 172, two lubricant guides 172*a* and 172*b* may be arranged respectively at both ends of the side belt guide 170 connected to the first guide 200*a* and the second guide 200*b* of the belt guide member 200. The belt guide member 200 is located near the fusing nip N and thus, relatively great pressure is applied between the belt guide member 200 and the fusing belt 140. Thus, when the fusing belt 140 passes the belt guide member 200, a relatively great amount of the lubricant is pushed to the longitudinal end of the fusing belt 140. The lubricant guide 172*a* located adjacent to the first guide 200*a* acts to move the lubricant toward the center of the fusing belt 140 before the fusing belt 140 passes the belt guide member 200. The lubricant guide 172*b* located adjacent to the second guide 200*b* returns the lubricant, which has been pushed to the longitudinal end of the fusing belt 140 while the fusing belt 140 passes the belt guide member 200, toward the center of the fusing belt 140.

The other lubricant guide 172*c* may be located at the center of the side belt guide 170 with respect to the rotating direction of the fusing belt 140.

As illustrated in FIGS. 4 and 8, the side belt guide 170 may be provided with a lubricant accommodation channel 176. The lubricant accommodation channel 176 is located between the lubricant guide 172 and the restraint wall 162 with respect to the longitudinal direction X of the fusing belt 140. The lubricant accommodation channel 176 may be elongated in the rotating direction of the fusing belt 140. The lubricant accommodation channel 176 serves to accommodate the lubricant pushed outward of the lubricant guide 172, thereby preventing leakage of the lubricant to the outside of the fusing belt 140.

The side belt guide 170 may include a first portion 170*a* protruding from the restraint wall 162 of the side frame 160 toward the center of the fusing belt 140, and a second portion 170*b* extending from the first portion 170*a* toward the center of the fusing belt 140, the second portion 170*b* being inclined relative to the first portion 170*a* in a direction away from the inner surface 142 of the fusing belt 140.

The second portion 170*b* of the side belt guide 170 is spaced apart from the inner surface 142 of the fusing belt 140 by a predetermined distance, providing a space for accommodation of the lubricant guided inward of the fusing belt 140 by the lubricant guide 172.

Figure 10:
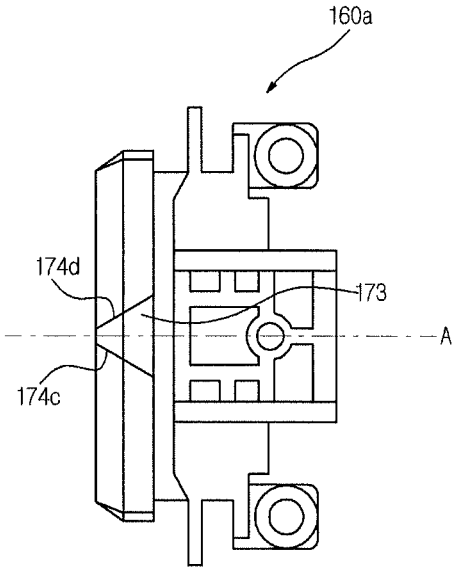
FIG. 10 is a plan view illustrating a side frame provided with a lubricant guide according to another embodiment.

FIG. 10 is a plan view illustrating the side frame provided with a lubricant guide according to another embodiment. As illustrated in FIG. 10, a lubricant guide 173 may have a symmetrical shape about an axis A parallel to the longitudinal direction X of the fusing belt 140. Specifically, the lubricant guide 173 may include a first ramp 174*c* and a second ramp 174*d* that are symmetrical to each other. An embodiment may have an advantage of using the same side frame 160*a* at either side of the fusing belt 140.

As is apparent from the above description, one or more embodiments include a fusing device to prevent a lubricant applied to an inner surface of a fusing belt from leaking to an outer surface of the fusing belt.

Preventing leakage of the lubricant may prevent contamination of recording media and peripheral elements. Further, there is less risk of increasing friction between the inner surface of the fusing belt and a nip plate because the lubricant is not leaked from the inner surface of the fusing belt, and thus, the fusing belt is free from frictional damage. Furthermore, it may be possible to prevent slippage between the fusing belt and a pressure roller due to lubricant leakage.

Although an embodiment has been shown and described, it would be appreciated by those skilled in the art that changes may be made in embodiments without departing from the principles and spirit of the invention, the scope of which is defined in the claims and their equivalents.

What is claimed is:

1. A fusing device comprising:

a fusing belt disposed in a rotatable manner;

a heat source placed in the fusing belt to heat the fusing belt;

a pressure roller including a shaft and an elastic layer surrounding the circumference of the shaft to apply pressure to an outer surface of the fusing belt; and a nip plate to support an inner surface of the fusing belt to define a fusing nip between the fusing belt and the pressure roller, wherein the nip plate includes:

a pressure portion arranged to face the pressure roller and to apply pressure to the inner surface of the fusing belt; and a stepped portion located at an outer side of the pressure portion and the elastic layer with respect to a longitudinal direction of the nip plate, the stepped portion being spaced apart from the inner surface of the fusing belt to define a space for accommodation of a lubricant applied to the inner surface of the fusing belt.

2. The fusing device according to claim 1, further comprising a side frame placed to rotatably support a longitudinal end of the fusing belt, wherein the side frame includes a side belt guide inserted in the fusing belt to support the inner surface of the fusing belt, and at least one lubricant guide protruding from the side belt guide to guide the lubricant on the end of the fusing belt toward the center of the fusing belt.

3. The fusing device according to claim 1, wherein the nip plate includes an extension bent from the pressure portion to extend in a direction away from the inner surface of the fusing belt.

4. The fusing device according to claim 3, wherein a bending junction of the nip plate where the pressure portion and the extension meet each other is located at an outer side of the elastic layer with respect to an axial direction of the pressure roller.

5. The fusing device according to claim 4, wherein a distance between the elastic layer and the bending junction of the nip plate with respect to the axial direction of the pressure roller is in a range of about 2 mm to about 5 mm.

6. The fusing device according to claim 1, further comprising a belt guide member placed near the fusing nip to guide the inner surface of the fusing belt, wherein the belt guide member includes sidewalls extending in a direction away from the fusing belt to define a space with the inner surface of the fusing belt, and wherein the space for accommodation of the lubricant is defined by the stepped portion of the nip plate and the sidewalls of the belt guide member.

7. The fusing device according to claim 2, wherein the lubricant guide includes a ramp inclined from the end of the fusing belt toward the center of the fusing belt in a rotating direction of the fusing belt.

8. The fusing device according to claim 7, wherein the lubricant guide has a symmetrical shape about an axis parallel to the longitudinal direction of the fusing belt.

9. The fusing device according to claim 2, wherein:

the side belt guide extends in an arcuate shape along an inner surface of the fusing belt; and the at least one lubricant guide includes a plurality of lubricant guides arranged on an outer circumference of the side belt guide in the rotating direction of the fusing belt.

10. The fusing device according to claim 2, wherein:

the side frame further includes a restraint wall to limit longitudinal movement of the fusing belt; and the side belt guide includes a lubricant accommodation channel provided between the lubricant guide and the restraint wall with respect to a longitudinal direction of the fusing belt, the lubricant accommodation channel extending in a rotating direction of the fusing belt.

11. The fusing device according to claim 2, wherein the side belt guide includes a first portion extending toward the center of the fusing belt, and a second portion extending from the first portion toward the center of the fusing belt, the second portion being inclined relative to the first portion in a direction away from the inner surface of the fusing belt.

12. A fusing device comprising:

a heat source to generate heat;

a fusing belt to rotate around the heat source, the fusing belt being heated by the heat source;

a pressure roller including a shaft and an elastic layer surrounding the circumference of the shaft to come into contact with an outer surface of the fusing belt at a pressure;

a side frame including a side belt guide to rotatably support an inner surface of the fusing belt at a longitudinal end of the fusing belt, and at least one lubricant guide protruding from the side belt guide to guide the lubricant on the end of the fusing belt toward the center of the fusing belt during rotation of the fusing belt;

a nip plate including a pressure portion arranged to face the pressure roller and adapted to apply pressure to the inner surface of the fusing belt so as to define a fusing nip between the fusing belt and the pressure roller; and a belt guide member to support the nip plate and guide the inner surface of the fusing belt near the fusing nip, the belt guide member including a lubricant receptacle defining a space with the inner surface of the fusing belt for accommodation of the lubricant on the inner surface of the fusing belt when the lubricant is pushed to the longitudinal end of the fusing belt by the pressure applied to the fusing nip, wherein the lubricant receptacle of the belt guide member is located at an outer side of the elastic layer with respect to an axial direction of the pressure roller.

13. The fusing device according to claim 12, wherein the nip plate includes an extension bent from the pressure portion to extend in a direction away from the inner surface of the fusing belt, and a stepped portion located in the lubricant receptacle of the belt guide member and spaced apart from the inner surface of the fusing belt.

14. The fusing device according to claim 12, wherein:

the belt guide member includes an arcuate first guide to guide the inner surface of the fusing belt at an upstream position of the nip plate with respect to a rotating direction of the fusing belt, and an arcuate second guide to guide the inner surface of the fusing belt at a downstream position of the nip plate with respect to the rotating direction of the fusing belt; and the first guide and the second guide of the belt guide member are provided at longitudinal ends thereof with grooves extending in the rotating direction of the fusing belt.

15. The fusing device according to claim 12, wherein the lubricant guide of the side frame includes a ramp inclined from the end of the fusing belt toward the center of the fusing belt in the rotating direction of the fusing belt.

16. The fusing device according to claim 14, wherein:

the side belt guide has an arcuate shape;

both ends of the arcuate side belt guide are connected respectively to the first guide and the second guide of the belt guide member; and the at least one lubricant guide includes a plurality of lubricant guides arranged on an outer circumference of the side belt guide in the rotating direction of the fusing belt.

17. The fusing device according to claim 16, wherein:

two of the lubricant guides arranged adjacent to the respective ends of the side belt guide connected to the first guide and the second guide of the belt guide member; and another lubricant guide located at the center of the side belt guide with respect to the rotating direction of the fusing belt.

18. An image forming apparatus including a fusing device to apply heat and pressure to a recording medium passing through a fusing nip so as to fix a non-fused image to the recording medium, wherein the fusing device includes:

a heat source to generate heat;

a fusing belt placed to be heated by the heat source, the fusing belt coming into contact with a surface of the recording medium on which the non-fused image has been formed so as to transfer heat thereto;

a pressure roller including a shaft and an elastic layer surrounding the circumference of the shaft to come into contact with an outer surface of the fusing belt at a pressure;

a nip plate to support an inner surface of the fusing belt so as to define a fusing nip between the fusing belt and the pressure roller, the nip plate including a pressure portion arranged to face the pressure roller and adapted to apply pressure to the inner surface of the fusing belt and a stepped portion located at an outer side of the pressure portion and the elastic layer with respect to a longitudinal direction of the nip plate, the stepped portion being spaced apart from the inner surface of the fusing belt so as to define a space for accommodation of a lubricant applied to the inner surface of the fusing belt; and a belt guide member placed to accommodate the nip plate and guide the inner surface of the fusing belt near the fusing nip, the belt guide member having an opening to allow heat radiated from the heat source to be directly transferred to the nip plate;

a support member placed to support the belt guide member and having an opening to directly pass the heat radiated from the heat source; and a heat transfer member placed between the heat source and the fusing belt, the heat transfer member including a body disposed around the heat source and heated by the heat source, an opening to allow heat radiated from the heat source to be directly transferred to the fusing belt, and a heat transfer portion to come into contact with the nip plate.

19. The image forming apparatus according to claim 18, wherein:

the fusing device further includes a side frame to rotatably support a longitudinal end of the fusing belt; and the side frame includes a side belt guide inserted in the fusing belt so as to support the inner surface of the fusing belt, and a lubricant guide protruding from the side belt guide to guide the lubricant on the end of the fusing belt toward the center of the fusing belt.

* * * * *